United States Patent [19]

Chandler et al.

[11] Patent Number: 4,900,024

[45] Date of Patent: Feb. 13, 1990

[54] BOWLING ALLEY BUMPER SYSTEM

[76] Inventors: John Chandler, 7641 Dentcrest, Dallas, Tex. 75240; Bobby R. Beene, 9919 Ila Dr., Dallas, Tex. 75220

[21] Appl. No.: 313,710

[22] Filed: Feb. 22, 1989

[51] Int. Cl.[4] ..... A63D 5/00

[52] U.S. Cl. ..... 273/37; 273/51; 273/54 R

[58] Field of Search ..... 273/51, 37, 54 R

[56] References Cited

U.S. PATENT DOCUMENTS

| | | | |
|---|---|---|---|
| 2,628,103 | 2/1953 | Parmer | 273/51 U X |
| 3,046,012 | 7/1962 | Marx | 273/51 |
| 3,401,933 | 9/1968 | Conklin et al. | 273/37 |
| 4,330,122 | 5/1982 | Sheinberg et al. | 273/51 |
| 4,420,155 | 12/1983 | Sheinberg et al. | 273/51 |

OTHER PUBLICATIONS

AMF "New Products on Parade" believed to be an exerpt from Magic Triangle News published by AMF Co., Bowling Products Group, Aug. 1965, p. 13 (copy enclosed).

*Primary Examiner*—Anton O. Oechsle
*Attorney, Agent, or Firm*—Andrew M. Hassell

[57] ABSTRACT

A bowling alley bumper system in which an elongated bumper is mounted alongside and parallel to each alley gutter, and in which there are provided movable supports that permit the extension of the bumpers to guard the gutters when guarding is desired and retraction of the bumpers to expose the gutters when normal alley operation is desired.

20 Claims, 3 Drawing Sheets

BOWLING ALLEY BUMPER SYSTEM

This invention relates to bowling alley bumper systems and more particularly to such systems in which elongated retractable bumpers are disposed alongside the gutters.

BACKGROUND OF THE INVENTION

Bowling alley bumper systems have heretofore been proposed, illustrative of which is that which is described in AMF Publication "New Products on Parade" published in 1965; and those described and claimed in U.S. Pat. No. 3,046,012 granted to David H. Marx for "Bowling Alley" on July 24, 1962; 4,330,122 granted to Zena Sheinberg et al. for "Convertible Bowling Alley" on May 18, 1982; and 4,420,155 granted on Zena Sheinberg et al. for "Convertible Bowling Alley" on Dec. 13, 1983.

While some of the currently available bumper systems may perform effectively, it has been found that the problems of disposing them in the desired locations (e.g., the gutters) or blowing them up (in the case of air bag types of bumpers) involve time, trouble and expense that make them less than completely satisfactory. Accordingly, there has continued to be a need for a system that is permanently positioned, does not interfere with normal operation of an alley and can be automatically deployed into the desired position while at the same time providing fully effective bumpering.

BRIEF SUMMARY OF THE INVENTION

The improved bowling alley bumper system according to the principles of this invention, includes retractably mounted bumpers that are deployed alongside conventional bowling alley gutters. Ordinarly, the bumpers are retracted and are positioned alongside the outer peripheries of the gutters so as to fully expose the gutters as in conventional bowling alleys. However, when it is desired to provide bumpering, the bumpers are extended into position so that they lie parallel to the gutters and nearer the alley surfaces so as to ward off bowling balls that otherwise would fall into the gutters.

OBJECTS AND FEATURES OF THE INVENTION

It is one general object of the invention to improve bowling alley bumper systems.

It is yet another object of this invention to increase the ease with which bumpers are positioned for active use and deactivated for inactive use.

It is still another object of the invention to facilitate storage of bowling alley bumpers when such bumpers are not in active use.

It is still another object of the invention to adapt bowling alley bumpers for remote actuation.

It is yet another object of the invention to simplify and reduce cost and complexity of permanently installed bowling alley bumper systems.

Accordingly, in accordance with one feature of the invention, a plurality of elongated members are retractably mounted alongside and parallel to the axis of a bowling alley, thereby providing permanent mounting while permitting extension for activation and retraction for deactivation, thus facilitating storage and use.

In accordance with another feature of the invention, nesting swivel mountings are employed for providing the aforementioned extension and retraction on adjacent alleys, thus simplifying such extension and retraction and economizing needed space.

In accordance with another feature of the invention, the swivel mountings are adapted for motorized actuation, thus adapting the system for remote control and operation.

In accordance with yet another feature of the invention, the aforementioned swivel mountings render the bumpering system simple in construction and operation, thus reducing cost and complexity.

These and other objects and features of the invention will become apparent from the following detailed description, by way of a preferred example, with reference to the drawings.

DESCRIPTION OF A PREFERRED EMBODIMENT

Figure 1:
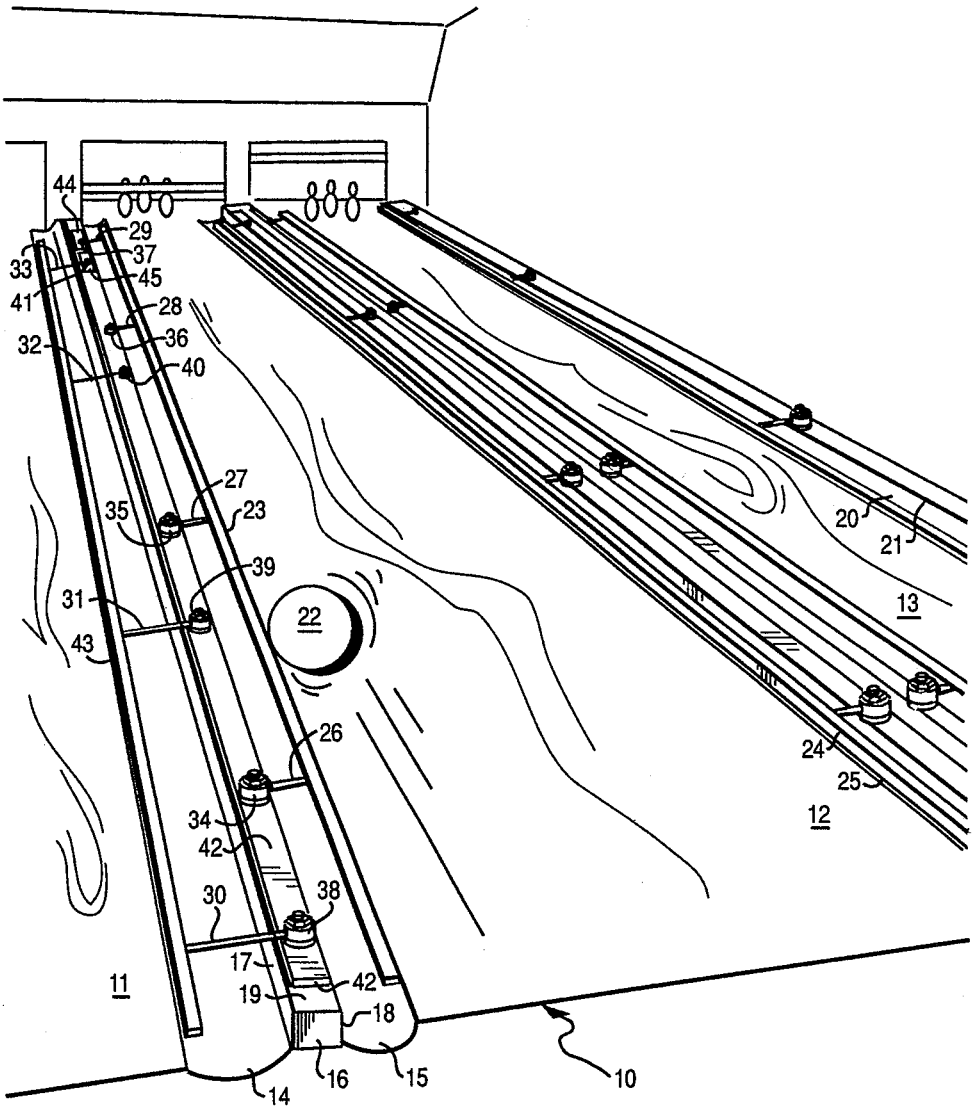
FIG. 1 is a perspective view depicting a bowling alley fitted out a bumpering system constructed in accordance with the principles of the invention.

Now turning to the drawing, and more particularly FIG. 1 thereof, it will be observed that it depicts a bowling alley fitted out a bumpering system constructed in accordance with the principles of the invention. There, it will be observed, is shown a portion of a conventional multi-alley bowling emporium 10 having alleys 11, 12 and 13. Alley 13 is seen to be an outside alley; that is, an alley having only one adjacent alley (i.e., alley 12); whereas alley 12 has two adjacent alleys, i.e., alleys 11 and 13.

It is customary to separate adjacent alleys (e.g., alleys 11 and 12) from each other by a pair of gutters such as gutters 14 and 15 between which there is positioned a longitudinal median or guide surface such as guide member 16 which marks the outer peripheries 17 and 18 of the gutters. Ordinarily this median or guide member is of sufficient width so as to provide needed separation between gutters and is surfaced with a horizontal cap such as cap 19 which may be constructed of any suitable material such as a wooden plank. Such a cap ordinarily extends essentiallythe entire length of the gutters (as shown) and consequently marks essentially the entire length of the alley.

Similar construction is employed for end alleys such as alley 13 except that, since there is but one adjacent alley (e.g., alley 12), the outer gutter such as gutter 20 is ordinarily bounded by a guide member such as guide member 21 which marks the boundary of but a single gutter (e.g., gutter 20) rather than a pair of gutters such as gutters 14 and 15.

Further reference to FIG. 1 reveals the presence of a conventional bowling ball 22 in progress down alley 12 and in contact with bumpering member 23 which is shown in the extended (active) position so as to guard gutter 15 and prevent balls from falling therein. A bumpering member 24 is shown to be in its extended position on the opposite side of alley 12 so as to guard its gutter 25 correspondingly. Thus, it will be observed, there is disposed a pair of bumpering members 23 and 24 which, when in extended positions as shown in FIG. 1, are effective to guard their respective gutters, ward off balls moving down the alley and thus direct such balls onward toward the pins which conventionally are positioned at the far end of each alley.

In accordance with one feature of the invention, the bumpers are mounted by projecting supports such as supports 26–33 which preferably are metallic rods, although other similar supports may readily be employed in practicing the principles of the invention. The supports (e.g. members 26–33) preferably are swivelably connected with swivels such as swivels 34–41 which provide connection to and support by the aforementioned guide member 16. As shown in FIG. 1, an intermediate mounting member 42 is provided for ease of assembly so that all of the swivels 34–41 may be attached thereto so as to provide an assembly that is convenient to mount on an alley guide member such as member 16. However, it will be apparent to one skilled in the art that if the geometries and materials from which guide member 16 are made are suitable, the intermediate mounting member 42 could be eliminated or modified, and the swivels 34–41 either mounted directly to the guide member or to independent, separate mounting members, one for each swivel but shorter in length than the single guide member shown in the Figures.

As mentioned above, another of the features of the invention is that the bumpers may be readily activated or inactivated without having to be transported physically to or away from the alleys or be inflated with a gaseous medium. The activation and deactivation of the bumpers is illustrated in detail in Figures 2–4 to which reference is now made. As mentioned above, FIG. 2 is a plan view illustrating a pair of bumpers mounted in partially nesting relationship on a relative narrow guide member (median) separating two adjacent alleys. This median corresponds to median guide member 16 of FIG. 1 and therefore is identified with the symbols 16*a*.

Figure 2:
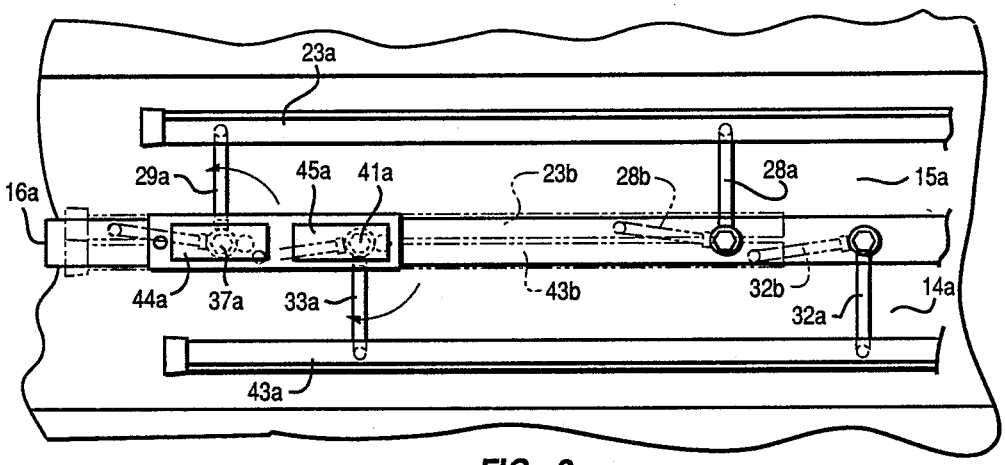
FIG. 2 is a plan view illustrating a pair of bumpers mounted in partially nesting relationship on a relative narrow median separating two adjacent alleys.

Deployment of the bumpers between their active and inactive positions may be readily accomplished by a manual swiveling movement of the bumpers or by motive power such as is illustrated by the conventional motor/gear box assemblies 44*a* and 45*a* depicted in FIG. 2. These assemblies, although shown separately, may be combined into a single assembly in accordance with principles well known to those skilled in the art. However, by using separate assemblies (as shown), provision is made for the individual deployment of the bumper associated with each gutter.

It should also be noted that is ordinarily desirable to retain flexibility so that each alley can be individually conditioned separately for bumper ball operation or normal alley function. Since medians ordinarily separate two different alleys from each other, it will be evident that if a single actuator is employed to deploy adjacent bumpers, one half of each such adjacent alleys will be conditioned for bumper ball operation. Accordingly, it normally is undesirable to actuate adjacent bumpers from a common source. If it is desired to utilize a common actuator to condition an alley for bumper operation, an extending arm, chain or other similar member could be attached to the actuator and positioned or extended beneath the alley surface (or high overhead so as not to interfere with other alley operations), and the other bumper for the alley could be connected thereto and actuated thereby.

Now returning to FIG. 2, it will be observed that parts similar to those described with respect to FIG. 1 are illustrated therein with similar designators excepting that the designators of FIG. 2 include suffix letters to distinguish them from those of FIG. 1. Thus, in FIG. 2 there are depicted the median guide member 16*a* gutters 14*a* and 15*a*, bumpers 23*a* and 43*a*, support arms 28*a*, 29*a*, 32*a* and 33*a*, and swivels 37*a* and 41*a*. Also shown are activating motor/gear box assemblies 44*a* and 45*a*.

The bumpering members 23*a* and 43*a* are shown in their extended (activated) positions where they are positioned sufficiently distant from median guide member 16*a* so as to prevent bowling balls from entering gutters 14*a* or 15*a*. In this connection, it will be observed by those skilled in the art that supports 28*a*, 29*a*, 32*a* and 33*a* (and the remaining supports) need not extend outwardly the full dimension of the gutter but only sufficiently so as to cause a bowling ball to impact the bumper (e.g., bumper 23*a*, 43*a*) before the lower surface of the ball in contact with the alley surface can contact part of the gutter. Thus, the bumpers may be extended to less or more than the inner edges of the gutters.

Further reference to FIG. 2 reveals that the retracted (inactive) position of the bumpers is depicted by dashed lines which are designed by identifying symbols that include suffix letters "b". Thus, the retracted position of bumper 23*a* is shown by the dashed lines 23*b*, and the retracted position of bumper 43*a* is shown by dashed lines 43*b*. In like fashion, the retracted position of support arm 28*a* is shown by dashed lines 28*b*, and the retracted position of support arm 32*a* is shown by dashed lines 32*b*.

As will be evident from an inspection of FIG. 2, when the bumpers are retracted (inactivated), they overlie the swivels and do not interfere with them. This will be evident from reference to FIGS. 5, 6 and 7 wherein it will be observed that the extending support arm 100 lies in a lower plane than that of the lower surface 101 of horizontal part 102 of bumper 103. Accordingly, when in its retracted position, lower surface 101 lies at a higher position than the top surface of swivel assembly 110 and clears it sufficiently so as to permit effective retraction.

Motor/gear box assemblies are well known in the art, and any of a number of commercially available types are suited for use in motorizing the bumper assemblies hereof. Examples of suitable motor/gear box assemblies are those manufactured by General Electric Company, Westinghouse Electric and the Grainger Company. These motor/gear box assemblies may be activated by conventional controls such as push buttons or switches that may be positioned at any convenient location such as at the motor/gearbox assembly or at a common control point.

If it is desired to manually deploy the bumpers into and out of action, such may be readily accomplished by disconnecting the motor/gear box assembly or assemblies (if included) and then by simply manually imparting force to the bumpers or to the supporting arms.

Figure 3:
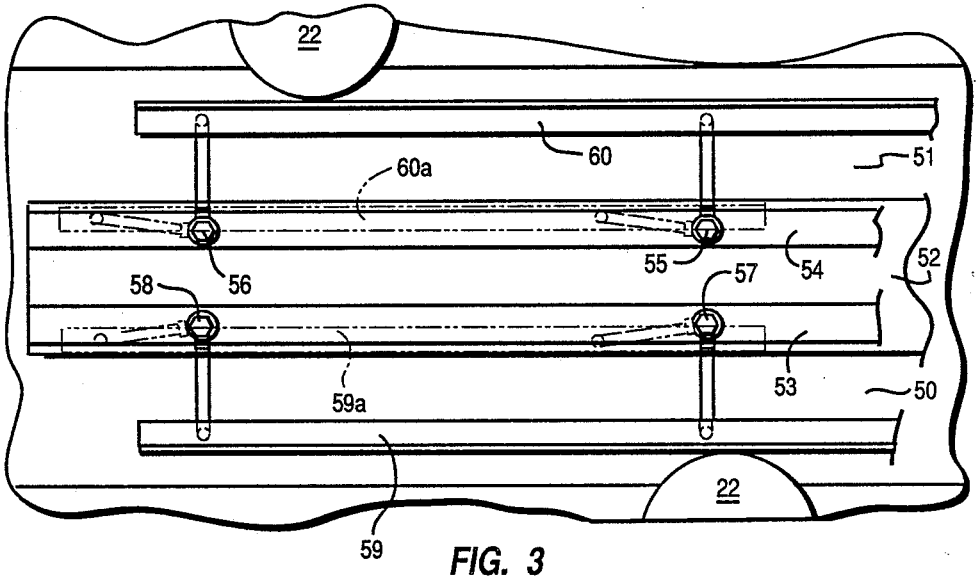
FIG. 3 is a view illustrating a pair of bumpers mounted in side-by-side relationship on a wider median separating two adjacent alleys and illustrating a bowling ball in contact with the bumpering surface of one of the bumpers.

FIG. 3 is similar to that of FIG. 2 except that manual rather than motor action is depicted, that each bumper has its own separate supporting base, and that the median guide member is sufficiently wide so as to accommodate such separation. Thus, there are depicted a pair of adjacent gutters 50 and 51 which are separated by a median guide member 52 on top of which are affixed two intermediate mounting members 53 and 54. These intermediate mounting members 53 and 54 serve as supports for swivels 55–58 in a manner similar to that described with respect to FIGS. 1 and 2. Shown in extended position are bumpers 59 and 60 which, when in retracted condition take the positions 59*a* and 60*a* represented by the corresponding dashed lines.

Figure 4:
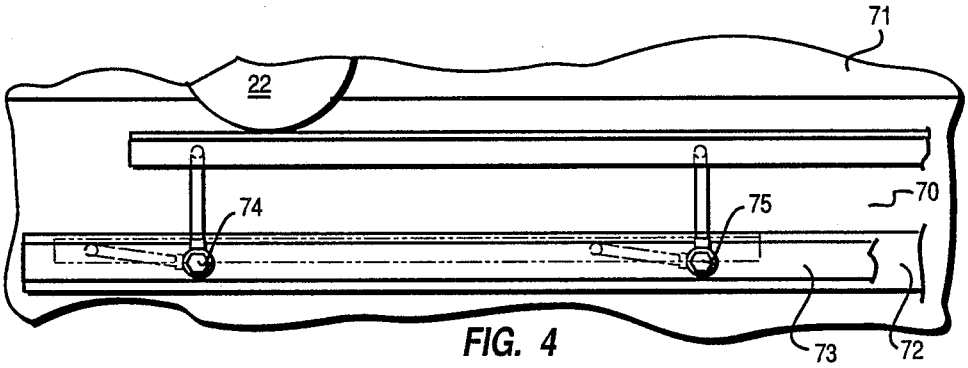
FIG. 4 is a plan view illustrating a single bumper lying alongside an alley as it is impacted by a bowling ball.

FIG. 4 illustrates details of a single bumper lying alongside an alley as it is impacted by a bowling ball. Such an arrangement will ordinarly be provided for each of the two outer alleys in a group of alleys (e.g., alley 13 of FIG. 1). Here, are depicted the gutter 70 bounded by alley surface 71 and median guide member 72. As with the previous figures, there is mounted atop member 72, an intermediate mounting member 73 which serves as a support for swivels 74 and 75. As with the previously described swivels, these swivels 74 and 75 may be operated manually or by actuator.

Figure 5:
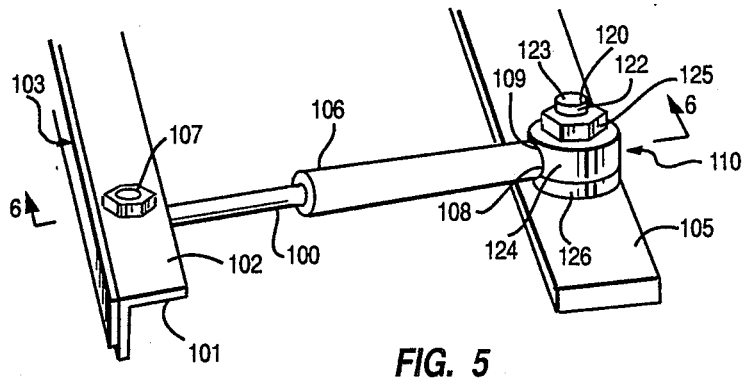
FIG. 5 is a perspective view of a typical mounting swivel mounted near the end of one of the bumpers.

FIG. 5 illustrates the preferred embodiment of the supports and swivels employed in practicing the inventive concepts hereof. There, it will be observed is shown a swivel assembly 110 which is mounted on supporting base 105. Such swivel assembly is shown in greater detail in FIG. 6. Depending from swivel assembly 110 is extending support arm 100 which may be rod shaped (as shown) or any other suitable geometry as will be evident to those skilled in the art. Connecting arm 100 to swivel assembly 110 is collar housing position 106 which also is described in greater detail with respect to FIG. 6. Connecting arm 100 is fastened to bumper 103 by fastening assembly 107 which also is shown in detail in FIG. 6.

As mentioned above, it will be observed that extending support arm 100 lies in a lower plane than that of the lower surface 101 of horizontal part 102 of bumper 103. Accordingly, when in its retracted position, lower surface 101 lies at a higher position than the top surface of swivel assembly 110 and clears it sufficiently so as to permit effective retraction. Of course, it will be evident to those skilled in the art that suitable clearance could be provided for in other ways. For example, such clearance could be provided by an offset in the axis of arm 100, the swivel could be shortened or recessed within member 105 and a fan shaped slot cut in part of member 102, or in a number of other ways that will be evident to those skilled in the art.

Figure 6:
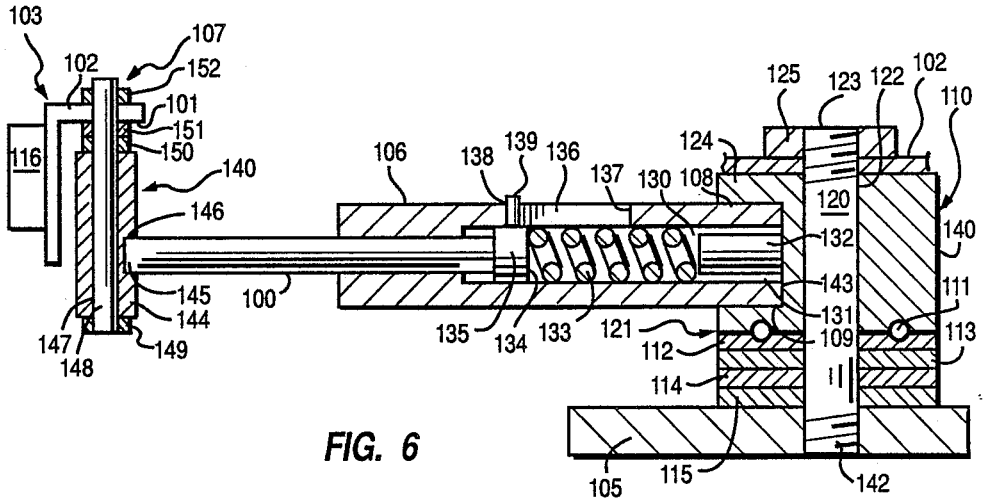
FIG. 6 is a sectional view depicting the preferred internal construction of one of the swivel arms of FIGS. 1–5.

Turning to now to FIG. 6, a preferred form of the support arm assembly will be seen. There, it will be observed, parts are designated with identifying numbers idential to those of FIG. 5. Swivel assembly 110 is seen to comprise central bolt-like member 120 having theaded shaft 122 teminating in end 123. Mounted on threaded shaft 122 is collar 124 and conventional nut 125. Mounted beneath collar 124 is bearing assembly 121 which comprises conventional ball bearings 111 disposed between collar 124 and bearing race 112. Also included are spacing washers such as those depicted at 113–115. These washers 113–115 provide for adjustment of the vertical position of arm 100 with respect to member 105. Arm 100 may be fastened to collar 124 through collar portion 106 by means of conventional threads on the exterior of inner part 108 thereof which mate with female threads within a conventional recess 109 in collar 124.

Within extending support arm 100 collar portion 106 there is preferably provided a shock absorbing assembly, although the shock of impact of bowling balls on the bumpers may be absorbed merely by providing cushioning material 116 on the surfaces thereof. If other alternative means of providing shock absorption are provided, the arm 100 may be continuous and omit the absorbing assembly as included within collar 106. However, in the preferred embodiment, a spring-loaded piston-like mechanism is provided (as shown in FIG. 6) to provide smooth cushioning of bowling ball impact and to extend the useful life of both ball and bumper.

As will be observed from further inspection of FIG. 6, there is provided within collar housing 106 a cylindrical recess 130 bounded at one end 131 by a spring stop plug 132 and at the remaining end 133 by the inner end 134 of collar 135 which, in turn, is mounted on extending support arm 100 as shown. Communicating from the exterior to the interior of cylindrical recess 130 is longitudinal slot 136 which has opposing ends 137 and 138 which provide limits to the movement of vertical stop member 139. Since stop member 139 is affixed to collar 135, provision is made to contain the limits of travel of collar 135 (and hence the extending portion of support arm 100) within collar housing 106.

Also in FIG. 6 there is depicted the aforementioned fastening assembly 107. Fastening assembly 107 comprises connecting swivel assembly 140 which is seen to interconnect the horizontal part 102 of bumper assembly 103 with support arm 100. Connecting swivel assembly 140 comprises body 144 to which arm 100 is fastened by any suitable means known in the art such as by screwing the threaded end 145 into a female threaded recess 146.

Extending vertically through body 144 is aperture 147 which may be have a smooth interior so as to provide one part of a sleeve-type bearing for co-acting with the exterior surface of rod-like shaft 148 so that shaft 148 may rotate (swivel) therein. Shaft 148 preferably is threaded at both ends so that it can be retained within body 144 by bottom nut 149, top nut 150 and jam nut 151. As will be observed from further reference to FIG. 6, either a slight clearance between the top surface of body 144 and the bottom surface of nut 150 and/or a slight clearance between the top surface of jam nut 151 and the lower surface 101 of horizontal part 102 of bumper 103 may provide the needed clearance so that arm 100 can swivel with respect to bumper 103. At the upper end of assembly 107 is seen fastening nut 152 which prevents bumper 103 from becoming disengaged from swivel assembly 140. As mentioned above, the ends of arm 100 may be affixed to their respective connecting members 124 and 144 by any suitable means such as threaded connections. However, other means of attachment may readily be employed such a shrink fitting.

Figure 7:
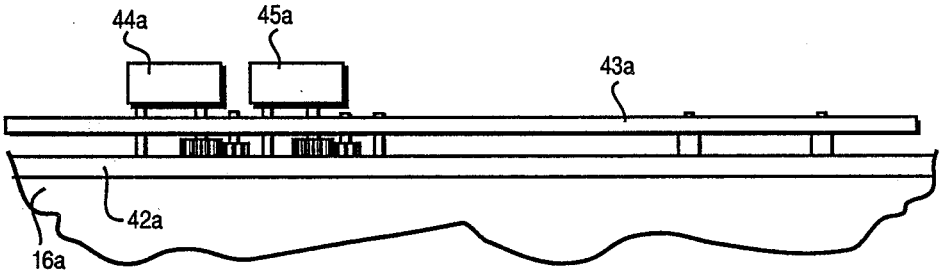
FIG. 7 is an elevation view of the assembly of FIG. 2.

As previously mentioned, FIG. 7 is an elevation view of the assembly of FIG. 2; and as will be observed, it depicts the preferred mode of powering the activation and deactivation of the bumpers. There, it will be observed are shown the two above-described conventional motor drive pinion gear assemblies 44*a* and 45*a* which are connected to swivel assemblies 37*a* and 41*a* and cause them to swivel upon application of energizing power to the motors. As depicted, the motor drive pinion gear assemblies are mounted sufficiently above the upper surface of median guide member 16a so as to provide necessary clearance for retracting the bumpers. Any suitable control device such as a push button, switch or computer (not shown) may be employed to energize and de-energize the motors and, of course, conventional limit switches are preferably included so as to prevent overdrive.

It will now be evident that there has been described herein, an improved bowling alley bumper system. It should also be evident that the described mechanism provides enhanced effectiveness while exhibiting improved operating characteristics; and that the system is simple in design, easy to install, and relatively inexpensive to manufacture, thus contributing to its attractiveness and desirability. As mentioned above, it additionally presents the advantage of being susceptible of permanent installation and of being relatively unobtrusive when not in use.

Although the invention hereof has been described by way of example of a preferred embodiment, it will be evident that other adaptations and modifications may be employed without departing from the spirit and scope thereof. For example, although the invention is illustrated as employing a pair of bumper mechanisms between adjacent alleys and one bumper mechanism along each of the two outer gutters of the two outer alleys, a pair of bumper mechanisms could be installed on each alley median guide cap member, with one of the pair in each of the outer cap guides of the two outer alleys remaining unused.

The terms and expressions employed herein have been used as terms of description and not of limitation; and thus, there is no intent of excluding equivalents, but on the contrary it is intended to cover any and all equivalents that may be employed without departing from the spirit and scope of the invention.

What is claimed is:

1. A bumper mechanism for guarding the gutter of a first bowling alley having a longitudinal guide surface adjacent and positioned alongside said gutter, said longitudinal guide surface being mounted on the opposite side of said gutter from said alley, said bumper mechanism comprising: guarding means including a first elongated bumper separated from and disposed alongside said gutter and having a major axis parallel to the major axis of said gutter, and extending and retracting means for mounting, extending and retracting said bumper, said extending and retracting means being interconnected between said bumper and said longitudinal guide surface; said extending and retracting means being effective when in its extended condition to position said guarding means for deflecting bowling balls that may be directed toward said gutter, and said extending and retracting means being effective when in its retracted condition to position said guarding means for exposing said gutter and permitting balls directed toward said gutter to fall thereinto.

2. A bumper mechanism according to claim 1 wherein said first elongated bumper is essentially parallel to said gutter and wherein said gutter is non-movable.

3. A bumper mechanism according to claim 1 further including a second alley adjacent to said first alley and wherein said longitudinal guide surface is disposed parallel to and between said gutter of said first alley and a gutter of said second alley, and wherein there is included a second elongated bumper disposed alongside said gutter of said second alley, and wherein said bumper mechanism further comprises: second guarding means including said second elongated bumper separated from and disposed alongside said gutter of said second alley and having a major axis parallel to the major axis of said gutter of said second alley, and second extending and retracting means for mounting, extending and retracting said second bumper, said second extending and retracting means being interconnected between said second bumper and said longitudinal guide surface; said second extending and retracting means being effective when in its extended condition to position said second guarding means for deflecting bowling balls that may be directed toward said second gutter, and said second extending and retracting means being effective when in its retracted condition to position said second guarding means for exposing said second gutter and permit balls directed toward said second gutter to fall thereinto.

4. A bumper mechanism according to claim 3 wherein said first elongated bumper is essentially parallel to said gutter and wherein said second elongated bumper is essentially parallel to said second gutter and wherein said gutter is non-movable.

5. A bumper mechanism according to claim 1 in which said extending and retracting means comprises at least two mounting arms each having two ends and each being supported at one of such ends by said longitudinal guide surface and each being connected at the remaining end to said bumper.

6. A bumper mechanism according to claim 5 and further including swivel means connecting said arms with said longitudinal guide surface.

7. A bumper mechanism according to claim 5 and further including swivel means connecting said arms with said bumper.

8. A bumper mechanism according to claim 5 and further including first swivel means connecting said arms with said longitudinal guide surface and further including second swivel means connecting said arms with said bumper.

9. A bumper mechanism according to claim 1 further including motor means interconnected with said extending and retracting means for operating said extending and retracting means to controllably extend and retract said bumper.

10. A bumper mechanism according to claim 5 wherein said mounting arms each comprise an elongated rod.

11. A bumper mechanism according to claim 8 wherein said mounting arms each comprise an elongated rod extending between said first swivel means and said second swivel means.

12. A bumper mechanism according to claim 11 wherein said mounting arms each include shock absorbing means.

13. A bumper mechanism according to claim 12 wherein said shock absorbing means includes a spring interconnecting said two ends of said mounting arms.

14. A bumper mechanism according to claim 5 wherein said means for mounting said bumper includes an intermediate mounting member disposed between one of said ends and said longitudinal guide surface.

15. A bumper mechanism according to claim 14 in which said intermediate member is segmented into a plurality of members.

16. A bumper mechanism for guarding the gutter of a first bowling alley having a longitudinal guide surface adjacent said gutter and parallel thereto, said longitudinal guide surface being disposed on the opposite side of said gutter from said alley, said bumper mechanism comprising: a first elongated bumper disposed alongside said bowling alley gutter and having its major axis parallel to the major axis of said gutter, extending and retracting means for mounting, extending and retracting said bumper, said extending and retracting means being interconnected between said bumper and said longitudinal guide surface, said extending and retracting means being effective when in its extended condition to position said bumper between the center line of said gutter and the adjacent edge of said alley thereby to deflect bowling balls that may be directed toward said gutter, and said extending and retracting means being effective when in its retracted condition to position said bumper adjacent said gutter and above said longitudinal guide surface, thereby to expose said gutter and permit balls directed toward said gutter to fall thereinto.

17. A bumper mechanism according to claim 16 further including a second alley adjacent to said first alley and wherein said longitudinal guide surface is disposed parallel to and between said gutter of said first alley and a gutter of said second alley, and wherein said bumper mechanism further comprises: a second elongated bumper disposed alongside said gutter of said second alley and having a major axis parallel to the major axis of said second gutter, second extending and retracting means for mounting, extending and retracting said second bumper, said second extending and retracting means being interconnected between said second bumper and said longitudinal guide surface, said second extending and retracting means being effective when in its extended condition to position said second bumper between the center line of said second gutter and the adjacent edge of said second alley thereby to deflect bowling balls that may be directed toward said second gutter, and said second extending and retracting means being effective when in its retracted condition to position said second bumper adjacent said second gutter and said longitudinal guide surface, thereby to expose said second gutter and permit balls directed toward said second gutter to fall thereinto.

18. A bumper mechanism according to claim 16 in which said extending and retracting means comprises at least two mounting arms each having two ends and each being supported at one of such ends by said longitudinal guide surface and each being connected at the remaining end to said bumper.

19. A bumper mechanism according to claim 18 and further including swivel means connecting said arms with said longitudinal guide surface.

20. A bumper mechanism according to claim 18 and further including swivel means connecting said arms with said longitudinal guide surface and further including swivel means connecting said arms with said bumper.

* * * * *